US007662221B2

(12) United States Patent
Fay

(10) Patent No.: US 7,662,221 B2
(45) Date of Patent: Feb. 16, 2010

(54) SPRAY APPLIED BUILDING WRAP COATING MATERIAL, SPRAY APPLIED BUILDING WRAP, AND BUILDING CONSTRUCTION ASSEMBLY

(75) Inventor: Ralph Michael Fay, Lakewood, CO (US)

(73) Assignee: Johns Manville, Denver, CO (US)

( * ) Notice: Subject to any disclaimer, the term of this patent is extended or adjusted under 35 U.S.C. 154(b) by 265 days.

(21) Appl. No.: 11/473,713

(22) Filed: Jun. 23, 2006

(65) Prior Publication Data

US 2007/0294976 A1 Dec. 27, 2007

(51) Int. Cl.
*C09D 5/14* (2006.01)
*E04B 5/00* (2006.01)

(52) U.S. Cl. ..... 106/15.05; 52/408; 52/302.1; 52/515; 52/516

(58) Field of Classification Search ..... 52/408, 52/409, 411, 516, 302.1; 428/141, 156, 172; 427/245, 256; 106/15.05, 2; 252/70
See application file for complete search history.

(56) References Cited

U.S. PATENT DOCUMENTS 2,402,474 A * 6/1946 van Dyck et al. ..... 428/489
2,566,169 A * 8/1951 Coffey et al. ..... 106/222
2,789,985 A * 4/1957 Harrison ..... 549/365
3,135,069 A * 6/1964 Schuller et al. ..... 52/516
3,266,206 A * 8/1966 Cosby et al. ..... 52/309.9
3,457,207 A * 7/1969 Gorke et al. ..... 106/265
3,645,835 A * 2/1972 Hodgson ..... 428/195.1
3,676,198 A * 7/1972 McGroarty ..... 427/180
3,681,276 A * 8/1972 Masamori et al. ..... 525/285
3,748,294 A * 7/1973 Kershaw et al. ..... 524/590
3,932,682 A * 1/1976 Loft et al. ..... 442/374
4,672,787 A * 6/1987 Murphy ..... 52/409
5,185,197 A * 2/1993 Nixon ..... 428/196

(Continued)

OTHER PUBLICATIONS

Sto Corp., Sto Guard: Superior Spray-On Building Wrap, Jul. 27, 2000, 4 page brochure, Sto Corp. of Atlanta Georgia.

(Continued)

*Primary Examiner*—Robert J Canfield
*Assistant Examiner*—Brent W Herring
(74) *Attorney, Agent, or Firm*—Robert D. Touslee

(57) ABSTRACT

A spray applied building construction coating material forms a waterproofing, water vapor permeable, air barrier, building wrap coating layer between an exterior facing surface of a building sheathing layer and an interior facing surface of an exterior building cladding layer. A building construction assembly is formed by spray coating the exterior surface of the sheathing layer with the coating material or by spray coating gaps in the sheathing layer with the coating material and spray coating the exterior surface of the sheathing layer and previously coated gaps in the sheathing layer with a second coat of the coating material and applying an exterior cladding layer over the coating layer(s). For most applications, the coating material is formulated or includes additives whereby it solidifies on the sheathing to form a coating layer that has an exterior facing, textured surface. This exterior facing, textured surface provides passages between the exterior facing surface of the coating layer and an interior facing surface of the exterior cladding layer for draining water from between and permitting air flow between the exterior facing surface of the coating layer and the interior facing surface of the exterior cladding layer.

7 Claims, 4 Drawing Sheets

U.S. PATENT DOCUMENTS

| | | | | |
|---|---|---|---|---|
| 5,593,771 | A * | 1/1997 | Lawless et al. | 428/317.3 |
| 5,671,889 | A * | 9/1997 | Petty | 239/418 |
| 5,979,131 | A * | 11/1999 | Remmele et al. | 52/309.9 |
| 5,996,304 | A * | 12/1999 | Barker et al. | 52/741.41 |
| 6,085,470 | A * | 7/2000 | Bigelow | 52/90.1 |
| 6,233,890 | B1 * | 5/2001 | Tonyan | 52/302.3 |
| 6,355,333 | B1 * | 3/2002 | Waggoner et al. | 428/174 |
| 6,410,118 | B1 * | 6/2002 | Reicherts et al. | 428/141 |
| 6,546,679 | B1 * | 4/2003 | Bushberger | 52/169.14 |
| 6,706,225 | B2 * | 3/2004 | Cabrey | 264/112 |
| 6,807,786 | B1 * | 10/2004 | Peck | 52/514.5 |
| 6,868,643 | B1 * | 3/2005 | Williams | 52/302.1 |
| 6,901,712 | B2 * | 6/2005 | Lionel | 52/408 |
| 6,901,713 | B2 * | 6/2005 | Axsom | 52/481.1 |
| 6,931,809 | B1 * | 8/2005 | Brown et al. | 52/409 |
| 7,096,630 | B1 * | 8/2006 | Keene et al. | 52/309.8 |
| 2001/0004490 | A1 * | 6/2001 | Wait | 428/217 |
| 2004/0103608 | A1 * | 6/2004 | Lionel | 52/408 |
| 2005/0229504 | A1 * | 10/2005 | Bennett et al. | 52/105 |
| 2005/0257469 | A1 * | 11/2005 | Bennett et al. | 52/408 |
| 2006/0040091 | A1 | 2/2006 | Bletsos et al. | |
| 2006/0051560 | A1 | 3/2006 | McKenna et al. | |
| 2008/0104917 | A1 * | 5/2008 | Whelan et al. | 52/408 |

OTHER PUBLICATIONS

Henry Company, Air-Bloc 31 Liquid Emulsion Vapor Permeable Air Barrier Membrane, Technical Data Sheet, Sep. 28, 2005, 3 pages, Henry Company.

Henry Company, Air-Bloc 33 UV Resistant Vapor Permeable Air and Weather Barrier Membrane,Technical Data Sheet, Jan. 1, 2005, 3 pages, Henry Company.

Henry Company, Blueskin Breather Self-Adhesive Vapor Permeable Transition Air Barrier Membrane,Technical Data Sheet, Jan. 1, 2005, 2 pages, Henry Company.

Joseph Lstiburek, Ph.D., Understanding Air Barriers, 2005, 10 pages, Building Science Corporation.

* cited by examiner 56
50
22
52
54
54

SPRAY APPLIED BUILDING WRAP COATING MATERIAL, SPRAY APPLIED BUILDING WRAP, AND BUILDING CONSTRUCTION ASSEMBLY

BACKGROUND OF THE INVENTION

The subject invention relates to a spray applied building construction coating material that forms a waterproofing, water resistant, water vapor permeable, air barrier, building wrap coating layer (i.e. a weather resistive barrier) between an exterior facing surface of a building sheathing layer and an interior facing surface of an exterior building cladding layer; to a spray applied building wrap; and to a building construction assembly formed by spray applying the coating material onto the sheathing, allowing the coating material to solidify to form a building wrap coating layer on the sheathing, and applying an exterior cladding layer over the building wrap coating layer. For many applications, it is preferable that the coating material solidify to form a building wrap coating layer with a textured exterior facing surface that provides passages between the exterior facing surface of the building wrap coating layer and an interior facing surface of the exterior cladding layer for draining water from between and permitting air flow between the exterior facing surface of the building wrap coating layer and the interior facing surface of the exterior cladding layer.

In current building construction weather resistive barriers providing some level of waterproofing, water vapor permeability, and air passage impedance (commonly referred to in the industry as building wraps) are frequently used between the exterior sheathing layer of the exterior wall and the exterior cladding layer of the exterior wall. The exterior sheathing layer is located on and secured the exterior side of the load-bearing framing members of the exterior wall. A major function of the building wrap is to prevent or minimize the intrusion of moisture into the exterior sheathing layer of the exterior wall, the framing members of the exterior wall, the insulation within the exterior wall, and the interior sheathing layer of the exterior wall. The exterior sheathing layer is normally formed of plywood, oriented strand board (OSB), foam insulation sheathing, nonwoven glass mat faced gypsum sheathing board, or other conventional sheathing materials commonly used in the construction industry and the exterior cladding layer is normally formed of brick, concrete blocks, reinforced concrete, stone, vinyl siding, fiber cement board, clapboard, or other conventional exterior siding materials commonly used in the construction industry. There are two basic forms of building wrap. The most common form of building wrap is a sheet building wrap and the less common form of building wrap is a spray applied building wrap.

Sheet building wraps are exemplified by Patent Application Publication No. US 2006/0040091 A1, Bletsos et al, published on Feb. 23, 2006 and Patent Application Publication No. US 2006/0051560 A1, McKenna et al, published on Mar. 9, 2006. Where moisture penetrates through the exterior cladding layer of an exterior wall to the building wrap layer, the presence of moisture on the surface of the building wrap layer can promote the growth of fungi and molds within the exterior wall. The building wrap of the McKenna et al patent application is embossed to form "drip channels or drainage channels" and promote moisture drainage from within an exterior wall to reduce the possibility of fungi or mold growth within an exterior wall due to the retention of moisture within the exterior wall. The utilization of these sheet building wraps as waterproofing, water vapor permeable, air barriers in exterior walls is not without its problems. The performance of the sheet building wrap layers formed by these sheet building wraps can be significantly degraded from any one or more of the following causes: the sheet building wraps of the sheet building wrap layer can become torn during application, adjacent sheet building wraps of the sheet building wrap layer can come apart at the seams between the sheets, and staples or other mechanical fasteners used to secure the sheet building wraps to the sheathing to form the sheet building wrap layer can create holes in the sheet building wraps that often enlarge, especially in windy conditions. In extreme weather conditions, large sections of the sheet building wraps often tear loose. To effectively form an air barrier, these sheet building wrap products must have all seams taped and the tops (roof side) and bottoms (foundation side) of the sheet products secured to the building with air sealing caulk, mastic, or tape. Without this level of detailed sealing the air barrier performance of the sheet building wrap layers formed with these sheet products is significantly less effective.

The ability of a building wrap to provide water drainage and an air wash is particularly important when the exterior cladding is a reservoir cladding (i.e. when it rains, the cladding gets wet and absorbs water). When the sun comes out after the rain has saturated the cladding, the heat of the sun drives some of the absorbed water out through the exterior side of the cladding, but the sun also drives a significant amount of the absorbed water into the cladding and out through the inner side of the cladding. This is especially common in porous cladding materials such as brick. Most cladding materials permit some amount of absorbed water to pass out through the inner side of the cladding material through various mechanisms. The two most common mechanisms functioning to pass water out through the inner side of the claddings are wind driven rain that penetrates through cracks and seams in the claddings and the claddings functioning as reservoirs.

Spray applied building wraps are exemplified by Sto Guard® spray applied building wrap marketed by Sto Corp. of Atlanta, Ga. and by Henry® Air-Bloc 31, Henry® Air-Bloc 33, and Henry® Blueskin® Breather marketed by Henry Company of Huntington Park, Calif. These spray applied building wraps are formed by spray applying a liquid that dries (solidifies) to form a waterproofing, water vapor permeable, air barrier coating layer, such as a liquid emulsion utilized by the Henry Company that solidifies into a rubberized (elastomeric) membrane. The use of spray applied building wraps rather than sheet building wraps to form a building wrap layer eliminates many of the problems associated with the use of sheet building wraps, such as those problems caused by sheet tears, seam separation, and fastener penetration and the formation of building wraps. In addition, the spray application of spray applied building wraps is relatively fast, easy, and does not require the use of highly skilled labor. However, these spray applied building wraps do not provide drip or drainage channels to promote moisture drainage from within an exterior wall to reduce the possibility of fungi or mold growth within an exterior wall due to the retention of moisture within the exterior wall.

SUMMARY OF THE INVENTION

One embodiment of the subject invention provides a solution to the deficiencies of the prior art building sheet wraps and spray applied building wraps through a spray applied elastomeric building construction coating material that forms a waterproofing, water vapor permeable, air barrier, building wrap coating layer with a textured exterior facing surface. The elastomeric coating material is spray applied onto a building sheathing layer and permitted to dry and solidify to form the building wrap coating layer. An exterior cladding layer is applied over the building wrap coating layer. The textured exterior facing surface of the building wrap coating layer prevents or greatly reduces the pooling of water in an exterior wall or sloped roofing system by providing passages between the exterior facing surface of the building wrap coating layer and an interior facing surface of the exterior cladding layer for draining water from between and permitting air flow between the exterior facing surface of the building wrap coating layer and the interior facing surface of the exterior cladding layer. This textured exterior surface also provides an air wash between the exterior cladding layer and the sheathing layer that helps drive moisture out of the interface between the exterior cladding and sheathing layers, minimizes the ability of moisture in the air to condense in the interface between the exterior cladding and sheathing layers, provides an easy path for moisture laden air to escape from the interface between the exterior cladding and sheathing layers, and enhances evaporation in the interface between the exterior cladding and sheathing layers that can actually be used to assist in cooling a building structure. As used herein, the term "textured surface" means a surface marked by ridges, projections, wrinkles, crinkles, inequities, and/or otherwise sufficiently broken, uneven, or bumpy to create water drainage and air flow passages between the exterior facing surface of the building wrap coating layer and the interior facing surface of the exterior cladding layer. In one embodiment of the invention, the spaces created by the building wrap coating layer in the interface between the exterior cladding and sheathing layers to form the water drainage and air flow passages are between about 0.04 inches (1 mm) and about 0.20 inches (5 mm) in depth.

Typically, the building sheathing layer is an exterior wall sheathing and/or a sloped roof deck sheathing layer and the exterior cladding layer is an exterior wall cladding and/or an exterior roof cladding layer. Examples of exterior wall sheathing materials are plywood, wooden boards, OSB, foam insulation sheathing, asphalt impregnated wood fiber board, nonwoven glass mat faced gypsum sheathing board, and other exterior wall sheathing materials commonly used in the construction industry. Examples of exterior wall cladding materials are brick, concrete blocks, reinforced concrete, stone, synthetic stone, vinyl siding, cement board, clapboard, or other conventional exterior siding materials commonly used in the construction industry. Examples of sloped roof deck sheathing materials are plywood, wooden boards, OSB, and other roof deck sheathing materials commonly used in the construction industry. Examples of exterior roof cladding materials are roofing shingles, tiles, roofing panels, roofing membranes such as single ply roofing membranes, built up modified bitumen roofing, and other exterior roof cladding materials commonly used in the construction industry.

In the embodiment of the spray applied elastomeric building construction coating material of the subject invention that forms a textured surface, the spray applied elastomeric building construction coating material is formulated or includes additives to cause a building wrap coating layer formed with the spray applied building construction coating material to have an exposed textured surface. In a first preferred embodiment of this form of the invention, the spray applied elastomeric building construction coating material, after being spray applied to sheathing, comprises an exterior portion that forms the exterior facing surface of the coating material, an inner portion that is in contact with and adhered to the sheathing, and an intermediate portion between the exterior portion and the inner portion of the coating material. The composition of the spray applied elastomeric building construction coating material causes the exterior portion of the coating material to dry and solidify at a different and faster rate than rates at which the intermediate portion and the inner portion of the coating material solidify to form wrinkles in the exterior facing surface of the exterior portion of the coating material and the exterior facing textured surface of the building wrap coating layer where the wrinkles are sufficiently large to generate the desired spaces between the cladding layer and the sheathing layer (e.g. to generate a water drainage plane and/or air wash). In a second preferred embodiment of this form of the invention, the spray applied elastomeric building construction coating material includes a particulate additive of particles that have an average size sufficiently large to form the exterior facing textured surface of the building wrap coating layer where the particulate additive is sufficiently large to generate the desired spaces between the cladding layer and the sheathing layer (e.g. to generate a water drainage plane and/or air wash). In a third preferred embodiment of this form of the invention, the viscosity and thixotropy of the spray applied elastomeric building construction coating material is adjusted so that the coating material can be sputter or splatter sprayed onto the exterior sheathing surface to create a textured surface on the building wrap coating layer formed from the spray applied coating material.

Another preferred embodiment of the spray applied building construction coating materials of the subject invention uses is a fiber containing elastomeric coating material for bridging gaps in the exterior sheathing layer. This fiber containing elastomeric coating material is concurrently applied to gaps (preferably, all gaps) in the exterior sheathing layer as a first or only coating layer bridging these portions of the sheathing layer. The exterior facing surface of the building wrap coating layer formed by this fiber containing elastomeric coating material can be smooth or textured. As used herein the term "gaps" includes, but is not limited to, joints in the exterior sheathing layer, outside and inside corners of the exterior sheathing layer, cracks in the exterior sheathing layer, openings in the exterior sheathing layer at penetrations through the exterior sheathing layer for utilities and duct work, and spaces between the exterior sheathing layer and window and door frames.

The spray applied elastomeric building construction coating materials of the subject invention may also have additional properties or include one or more of the following additives to further enhance the performance of the coating materials and the building wrap coating layers formed with the coating materials: low emissivity, termiticides(s), fungi growth inhibiting agent(s), phase change material(s), etc.

The spray applied elastomeric coating materials of the subject invention, may be spray applied to the exterior facing surfaces of the sheathing layers of the walls, overhangs, eves, and/or roof of a building structure to form waterproofing, water resistant, water vapor permeable, building wraps that can significantly retard or minimize air infiltration or to all of the above ground exterior facing surfaces of the sheathing layers of the building structure to a form waterproofing, water resistant, water vapor permeable, building wrap that can significantly retard or minimize air infiltration. A building structure that has the exterior facing surfaces of the exterior sheathing layers completely coated with the spray applied building wrap of the subject invention forms a waterproofing, water resistant, water vapor permeable, building enclosure that can significantly retard or minimize air infiltration.

DETAILED DESCRIPTION OF THE INVENTION

Figure 1:
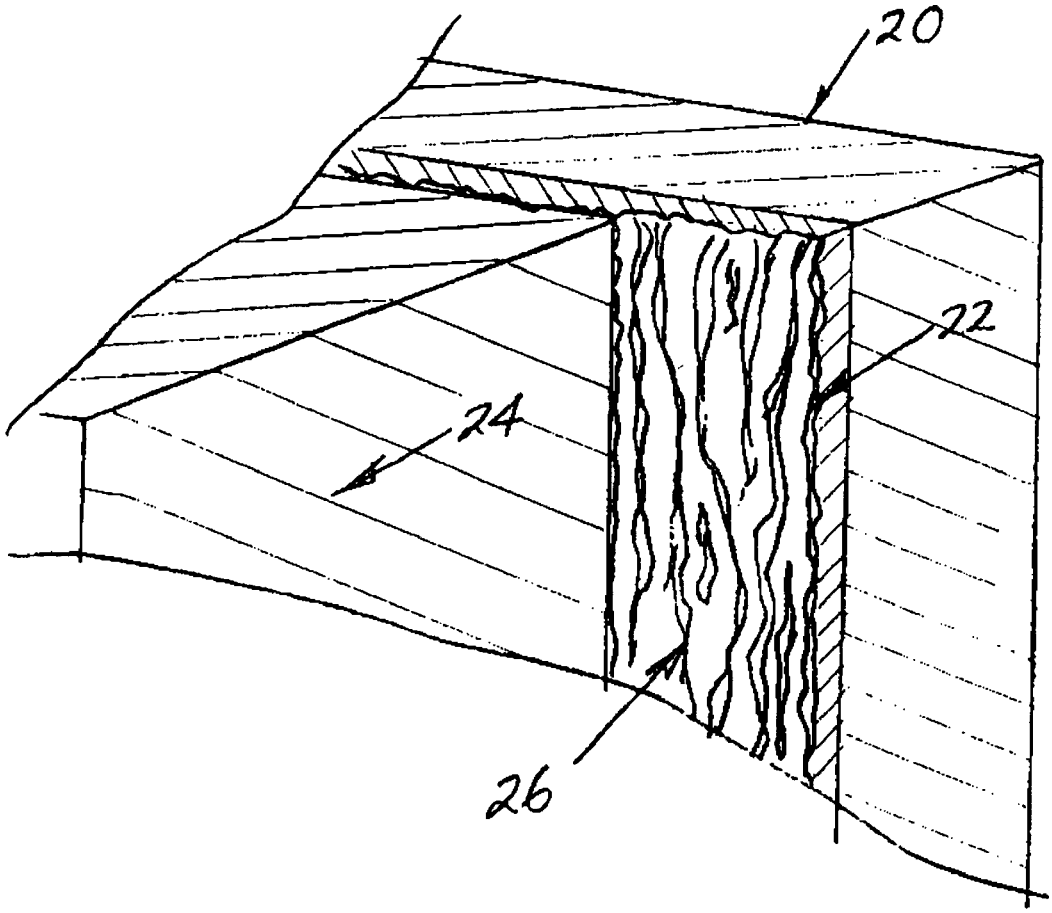
FIG. 1 is a perspective view of a small portion of a building construction assembly of the subject invention, on an enlarged scale, to better schematically show the exterior facing textured surface of the building wrap layer.

As schematically shown in FIG. 1, the spray applied, elastomeric building construction coating material of the subject invention, when spray applied to coat an exterior facing surface of a building sheathing layer 20 (such as an exterior wall sheathing layer that overlies the load-bearing framing members of an exterior wall, a sloped roof deck sheathing layer that overlies the inclined rafter members of a roofing system, a transition or junction between the exterior wall and the roof deck, or a transition or junction between the foundation and the exterior wall) forms a waterproofing, water vapor permeable, air barrier, building wrap coating layer 22. The elastomeric coating material is spray applied, in liquid form, onto an exterior facing surface of a building sheathing layer 20, to form a building wrap coating layer 22 that is adhered to and coextensive with or substantially coextensive with the exterior facing surface of the sheathing layer 20. The elastomeric coating material is permitted to dry and solidify to form the building wrap coating layer 22. An exterior building material cladding layer 24 is then applied over the building wrap coating layer 22. In one preferred embodiment of the building wrap coating layer 22, the exterior facing surface 26 of the building wrap coating layer 22 is sufficiently textured to provide passages between the exterior facing surface of the building wrap coating layer 22 and an interior facing surface of the exterior building material cladding layer 24 for draining water from between and permitting air flow between the exterior facing textured surface 26 of the building wrap coating layer 22 and the interior facing surface of the exterior building material cladding layer 24.

The spray applied building construction coating material of the subject invention is a water-based elastomeric emulsion, such as but not limited to a water-based acrylic emulsion or an oil-based elastomeric emulsion, such as but not limited to a rubberized (elastomeric) emulsion. For many applications, the spray applied elastomeric building construction coating material of the subject invention is formulated or includes additives to cause a building wrap coating layer 22 formed with the spray applied building construction coating material to have an exposed surface 26 that is sufficiently textured to form moisture drainage and air flow passages for preventing or greatly reducing the accumulation and pooling of water between the textured surface 26 of the building wrap layer and the exterior cladding layer. The elastomeric emulsions forming these coating materials may include fillers to reduce product costs or enhance the performance of the coating emulsions, such as but not limited to chopped glass fibers, chopped plastic fibers, cellulose fibers, small nodules of glass, plastic, or cellulose fibers, or mixtures of one or more of these fibers, that can: a) function as a reinforcement and spanning material to facilitate the bridging of gaps with the spray applied elastomeric building construction coating material; and/or b) contribute to the formation of a textured surface on the building wrap coating layer formed with the coating material. At least some fillers can be incorporated into the emulsions as part of the elastomeric coating material prior to spraying the elastomeric coating material. Other fillers, such as but not limited to chopped glass fibers, other chopped fibers, or small nodules of fibers can be sprayed concurrently with the elastomeric coating material and mixed with the elastomeric coating material as the coating material and the chopped fibers are applied to the surface of the sheathing layer to form an elastomeric coating layer reinforced with the chopped fibers.

In a first preferred embodiment of the spray applied elastomeric building construction coating material for forming building wrap layers with textured surfaces, the spray applied elastomeric building construction coating material is formulated so that, after being spray applied onto sheathing, the coating material comprises an exterior portion that forms the exterior facing surface of the coating material, an inner portion that is in contact with and adhered to the sheathing, and an intermediate portion between the exterior portion and the inner portion of the coating material. The composition of the spray applied elastomeric building construction coating material causes the exterior portion of the coating material to solidify at a different and faster rate than the rates at which the intermediate portion and the inner portion of the coating material solidify to form wrinkles in the exterior facing surface of the exterior portion of the coating material and the exterior facing textured surface 26 of the building wrap coating layer 22. When using an oil-based elastomeric emulsion as the coating material, tung oil may be included in the emulsion to cause the intermediate and inner portions of the coating material to dry or solidify at rates sufficiently slower than the rate at which the exterior portion of the coating material dries or solidifies to form a coating layer with a wrinkled, textured surface.

In a second preferred embodiment of the spray applied elastomeric building construction coating material for forming building wrap layers with textured surfaces, the spray applied elastomeric building construction coating material includes one or more particulate additives of particles that have an average size or diameter sufficiently large to form the exterior facing, textured surface 26 of the building wrap coating layer 22. Examples of particulate additives that may be used to create a textured surface on the building wrap coating layer are granules or glass spheres ranging from about 200 to about 600 micrometers in diameter, expanded polystyrene beads or bits ranging from at least 200 micrometers to more than 2500 micrometers (about 0.1 inches at their maximum dimension or diameter), fibrous nodules, and microcapsules of phase change material that typically are about 2 to 100 micrometers in diameter. These textured surface-generating additives can be mixed with the liquid spray emulsion of the coating material or added to the coating material as a separate concurrently applied spray.

In a third preferred embodiment of the spray applied elastomeric building construction coating material for forming building wrap layers with textured surfaces, the viscosity and thixotropy of the coating material can be adjusted so that the coating material can be sputter or splatter sprayed onto the exterior sheathing surface, in a fashion similar to a spray on wall board texture, to create a textured surface on the building wrap coating layer formed from the spray applied coating material. Just as in wallboard texture, the spray droplet size and amount of application controls the texture pattern from that of a light orange peel (the texture of an orange peel) to that of a heavily textured surface.

A preferred spray applied elastomeric building construction coating material product and system of the subject invention for bridging gaps in the sheathing layer uses a gap bridging fiber containing elastomeric coating material that is concurrently applied to gaps (preferably, all gaps) in the exterior sheathing layer as a first coating layer bridging these portions of the sheathing layer of a two coating layer system or a single coating layer bridging these portions of the sheathing layer. The ratio of fiber to elastomeric coating material in the fiber containing elastomeric coating material is sufficiently high so that the gaps are bridged with a coating layer containing a semi-continuous fiber web. The fibers utilized in the gap bridging fiber containing elastomeric coating material may be or include chopped glass fibers, chopped plastic fibers, cellulose fibers, small nodules of glass, plastic, or cellulose fibers, or mixtures of one or more of these fibers that function as a reinforcement and spanning material to facilitate the bridging of gaps with the spray applied elastomeric building construction coating material. For certain applications, the fibers may be contained in and sprayed with the elastomeric coating material. Where this form of application is precluded or not preferable, e.g. due to the amount of fibers to be included in the fiber reinforced coating layer being formed, the fibers can be sprayed concurrently with the elastomeric coating material and mixed with the elastomeric coating material as the coating material and the fibers are applied to the surface of the sheathing layer to form the fiber reinforced elastomeric coating layer. The exterior facing surface of the coating layer formed by the gap bridging fiber containing elastomeric coating material may be a smooth or textured surface and where the coating layer has a textured surface, the fibers may also contribute to the formation of the textured surface on the building wrap coating layer formed with the coating material.

Preferably, the gap bridging fiber containing elastomeric coating material of the subject invention will form a coating layer with a fiber web that has the ability to expand and contract with the sheathing layer with little or no degradation of the building wrap coating layer. This will enable the joints between sheets of sheathing, such as OSB sheathing, non-woven glass mat faced gypsum sheathing board, and foam insulation sheathing, to expand and contract a few millimeters as these sheets transition between hot and cold and wet and dry without losing the desired waterproof, water vapor permeable, air barrier spray applied building wrap overlying the joints. For extreme applications, it may be beneficial to use fiber reinforcements that can stretch or elongate and contract e.g. the fibers are made of an elastic material, with the coating layer as the sheathing of the sheathing layer expands and contracts.

Where the gap bridging fiber containing elastomeric coating material is applied as the first coating layers of a two coating system, the first coating layers bridging the various gaps in the sheathing layer are permitted to dry and solidify sufficiently (a period of about one to several minutes) so that a second coating layer of an elastomeric coating material can be applied over and adhered to the first coating layers and the remainder of or other portions of the sheathing layer being coated to form a sprayed building wrap. In the two coating system, the elastomeric coating material forming the second coating layer may or may not contain the gap bridging fiber. Depending on whether a drainage plane or air wash is desired, the elastomeric coating material forming the second coating layer may or may not form an exterior facing textured surface. A uniform and sufficient amount of the second elastomeric coating material is applied to form the desired waterproof, water vapor permeable, air barrier spray applied building wrap over the entire surface of the sheathing layer and double reinforced waterproof, water vapor permeable, air barrier spray applied building wrap coating layers over and bridging the gaps in the sheathing layer. For the purposes of visualizing the finished two coating system, compare this operation to how interior wallboard is finished by first applying a paper or scrim tape over the joints and then covering the tape with a coating of wallboard mud. Similarly in the two coating operation of the subject invention, the first coating material is spray applied over the gaps in a sheathing layer to form, in-situ, spray-on tapes of the fiber containing elastomeric coating material. These on-site formed tapes are then covered with a second coating material that is spray applied over the on-site formed tape. The remainder of the sheathing layer is also spray coated with the second coating material to complete the formation of the spray applied building wrap.

Where the gap bridging fiber containing elastomeric coating material is employed as on-site formed, spray-on tapes to bridge gaps in an external sheathing layer, such as but not limited to oriented strand board (OSB) sheathing layers and foam insulation sheathing layers, the gap bridging fiber containing elastomeric coating material is concurrently spray applied over the various gaps in the exterior sheathing layer to bridge and close the gaps with a waterproof, water vapor permeable, air barrier coating layer (spray-on tapes). The spray-on tapes of the subject invention can be used to close the various gaps in an external sheathing layer with sheathing, such as oriented strand board (OSB) sheathing and foam insulation sheathing, and thereby form a waterproof, water vapor permeable, air barrier building wrap that can include only the spray-on tapes and sheathing. By closing the gaps in the exterior sheathing layer with the spray applied waterproof, water vapor permeable, air barrier coating layer of the subject invention, the labor intensive taping procedures normally employed to close these gaps is eliminated and the waterproofing, water vapor permeability, and air passage impedance of the exterior sheathing layer can be improved.

Preferably, the building wrap coating layer 22 has an air permeability of 0.004 cfm/ft$^2$ [0.02 l/(s·m$^2$)] @ 75 Pa or less when spray applied onto the exterior facing surface of the sheathing at a dry thickness of 0.12 inches or greater, more preferably at a dry thickness of 0.018 inches or greater, and most preferably at a dry thickness of 0.003 inches or greater. With regard to the building construction assemblies of the subject invention, such as the building construction assemblies 30, 50, and 60 of FIGS. 2, 3, and 4, preferably these building construction assemblies have an air permeability of 0.04 cfm/ft$^2$ [0.20 l/(s·m$^2$)] @ 75 Pa or less. With regard to a building structure enclosed by a building enclosure coating layer formed by the spray applied building wrap coating layer of the subject invention, preferably the building enclosure has an air permeability of 0.4 cfm/ft$^2$ [2.00 l/(s·m$^2$)] @ 75 Pa or less.

Preferably, the building wrap coating layer 22 is waterproof at a dry thickness of about 0.12 inches, more preferably at a dry thickness of about 0.018 inches, and most preferably at a dry thickness of about 0.003 inches. Preferably, the building wrap coating layer has a water vapor permeability greater than 1 perm and more preferably, equal to or greater than 5 perms when spray applied onto the exterior facing surface of the sheathing layer at a dry thickness between 0.003 inches and 0.018 inches and preferably, at a dry thickness of up to 0.12 inches. While any level of emissivity is beneficial when combined with an air space intermediate the exterior surface of the building wrap coating layer and the interior surface of the cladding layer, preferably, the building wrap coating formed by the spray applied building construction coating material has an emissivity of less than 0.30, more preferably less than 0.10, and most preferably less than 0.045.

The spray applied elastomeric building construction coating materials of the subject invention may also include one or more of the following additives to further enhance the performance of the coating material and the building wrap coating layers formed with the coating material: termiticides(s), fungi growth inhibiting agent(s), phase change material(s), etc. The following are examples of fungi growth inhibiting agents that may be used in the spray applied building construction coating material of the subject invention: 2-(4-Thiazolyl) Benzimidazole (a chemical also known as "TBZ"), sold by Ciba Specialty Chemicals under the trade designation Iraguard F 3000; silver zeolyte sold by Rohm & Haas Company under the trade designation KATHON; and Zinc Pyrithione, sold by Arch Chemicals Inc. under the trade designation Zinc Omadine. The use of TBZ and Zinc Pyrithione together may have a synergistic affect to enhance the fungi growth resistance of the coating material.

Where it is desired to passively absorb and store excessive heat during a certain period (e.g. the day) and discharge heat during another period (e.g. the night) to maintain a more constant temperature within a building or room and conserve energy, the coating material of the subject invention can include one or more phase change materials, encapsulated within microcapsules, that latently store and release thermal energy. The microcapsules have shells that are preferably filled or substantially filled with the phase change material(s) and are typically about 5 to 10 mm in diameter. The microcapsule shells are impervious to the phase change material(s) in its/their liquid form, are not degraded by the phase change material(s), and can withstand the phase changes of the phase change material(s) (including the volume increases that occur during the melting cycle) without leaking. The phase change material(s) utilized in the microcapsules absorb energy (heat) during a melting cycle (fusion cycle) of the phase change material(s) where the phase change material(s) physically changes from a solid or crystalline form to a liquid form at a nearly constant temperature within the temperature range of about 65° F. (18° C.) to about 150° F. (66° C.) and release energy (heat) during a solidification or crystallization cycle where the phase change material(s) physically change from a liquid to a solid or crystalline form at a nearly constant temperature within the temperature range of about 65° F. (18° C.) to about 150° F. (66° C.). Due to the small volume increase and low vapor pressure exhibited when phase change material (s) physically change from a solid to a liquid, phase change material(s) are used in the microcapsules that undergo a solid to liquid phase change within this temperature range rather than a liquid to gas phase change, which would result in a huge volume increase. Paraffin waxes and other commercially available phase change materials may be used in the microcapsules that undergo solid to liquid and liquid to solid phase changes within the above temperature range and have a latent heat storage capacity of at least 160 J/g and preferably at least 180 J/g. The particular phase change material(s) selected for the microcapsules is selected in part for having its/their phase change occur at a desired temperature within the temperature range set forth above in this paragraph.

Figure 2:
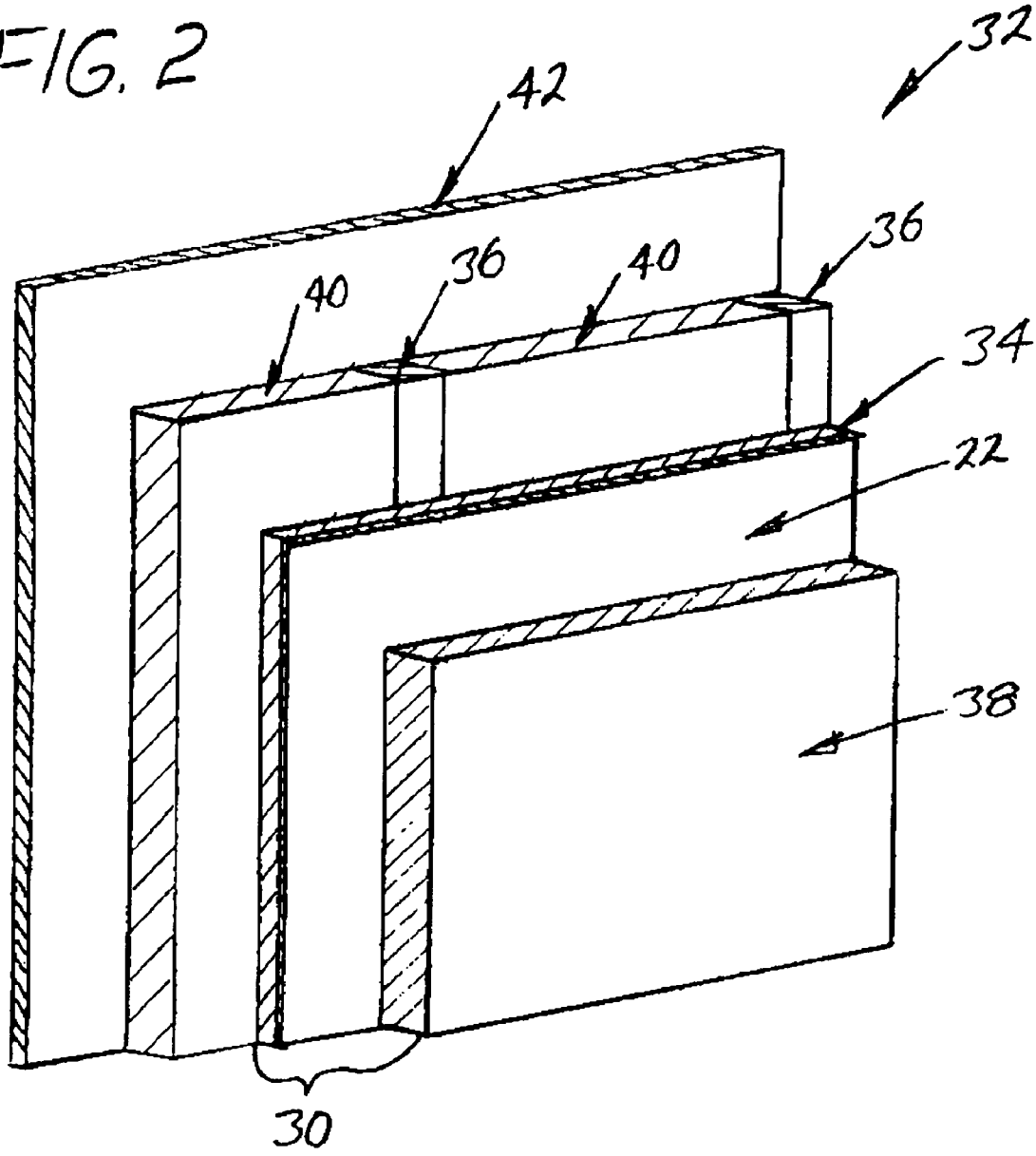
FIG. 2 is a schematic perspective view of an exterior wall embodying a building construction assembly of the subject invention with portions broken away to better illustrate the building construction assembly.

An example 30 of a typical building construction assembly of the subject invention, forming part of an exterior building wall 32, includes: an exterior wall sheathing layer 34 overlying and secured to the exterior facing surfaces of load-bearing, wall framing members 36 of the exterior building wall; the building wrap coating layer 22 spray applied to, overlying, adhered to, and coextensive with or substantially coextensive with the exterior facing surface of the sheathing layer 34; and an exterior wall cladding layer 38 overlying the exterior facing surface of the building wrap coating layer 22. As shown in FIG. 2, the exterior building wall 32 also normally includes insulation, such as but not limited to blankets of fiberglass building insulation 40, in the wall cavities formed between the framing members 36 and an interior sheathing layer 42 formed of interior sheathing materials (such as but not limited to plasterboard, gypsum board, and other conventional interior sheathing materials) and secured to the interior facing surfaces of the framing members 36. Examples of exterior wall sheathing materials for forming the sheathing layer 34 are plywood, OSB, wooden boards, nonwoven glass mat faced gypsum sheathing boards, foam insulation sheathing, and other exterior wall sheathing materials commonly used in the construction industry. Examples of exterior wall cladding materials for forming the exterior wall cladding layer 38 are brick, concrete blocks, reinforced concrete, stone, synthetic stone, vinyl siding, fiber cement board, clapboard, or other conventional exterior siding materials commonly used in the construction industry.

Figure 3:
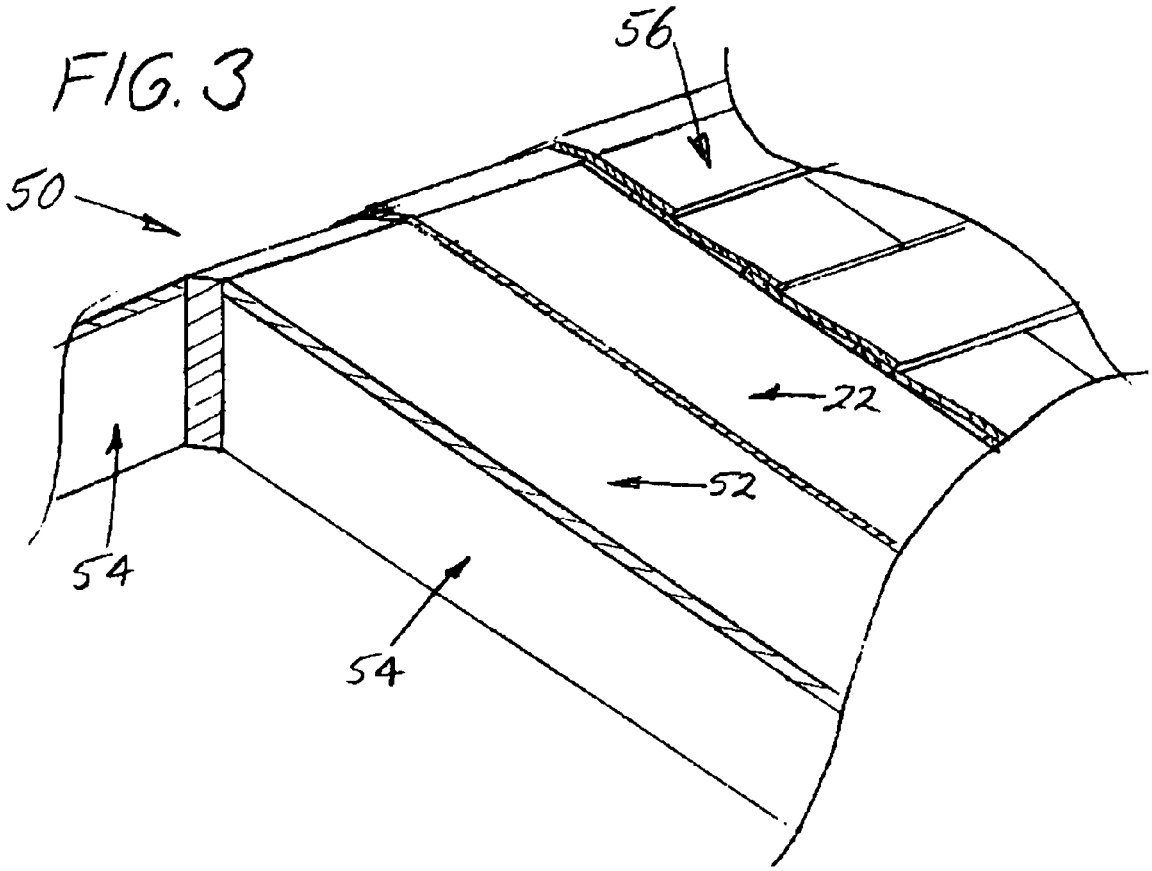
FIG. 3 is a schematic perspective view of a sloped roofing system embodying a building construction assembly of the subject invention with portions broken away to better illustrate the building construction assembly.

An example 50 of a typical building construction assembly of the subject invention, forming part of a sloped roofing system shown in FIG. 3, includes: a sloped roof deck sheathing layer 52 overlying and secured to the exterior facing surfaces of inclined roof rafter members 54 of the sloped roofing system; the building wrap coating layer 22 spray applied to, overlying, adhered to, and coextensive with or substantially coextensive with the exterior facing surface of the sheathing layer 52; and an exterior roof system cladding layer 56 overlying the exterior facing surface of the building wrap coating layer 22. Examples of sloped roof deck sheathing materials for forming the sloped roof deck sheathing layer 52 are plywood, OSB, wooden boards, and other roof deck sheathing materials commonly used in the construction industry. Examples of exterior roof cladding materials for forming the exterior roof system cladding layer 56 are roofing shingles, tiles, roofing panels, roofing membranes such as single ply roofing membranes, built up modified bitumen roofing, and other exterior roof cladding materials commonly used in the construction industry.

Figure 4:
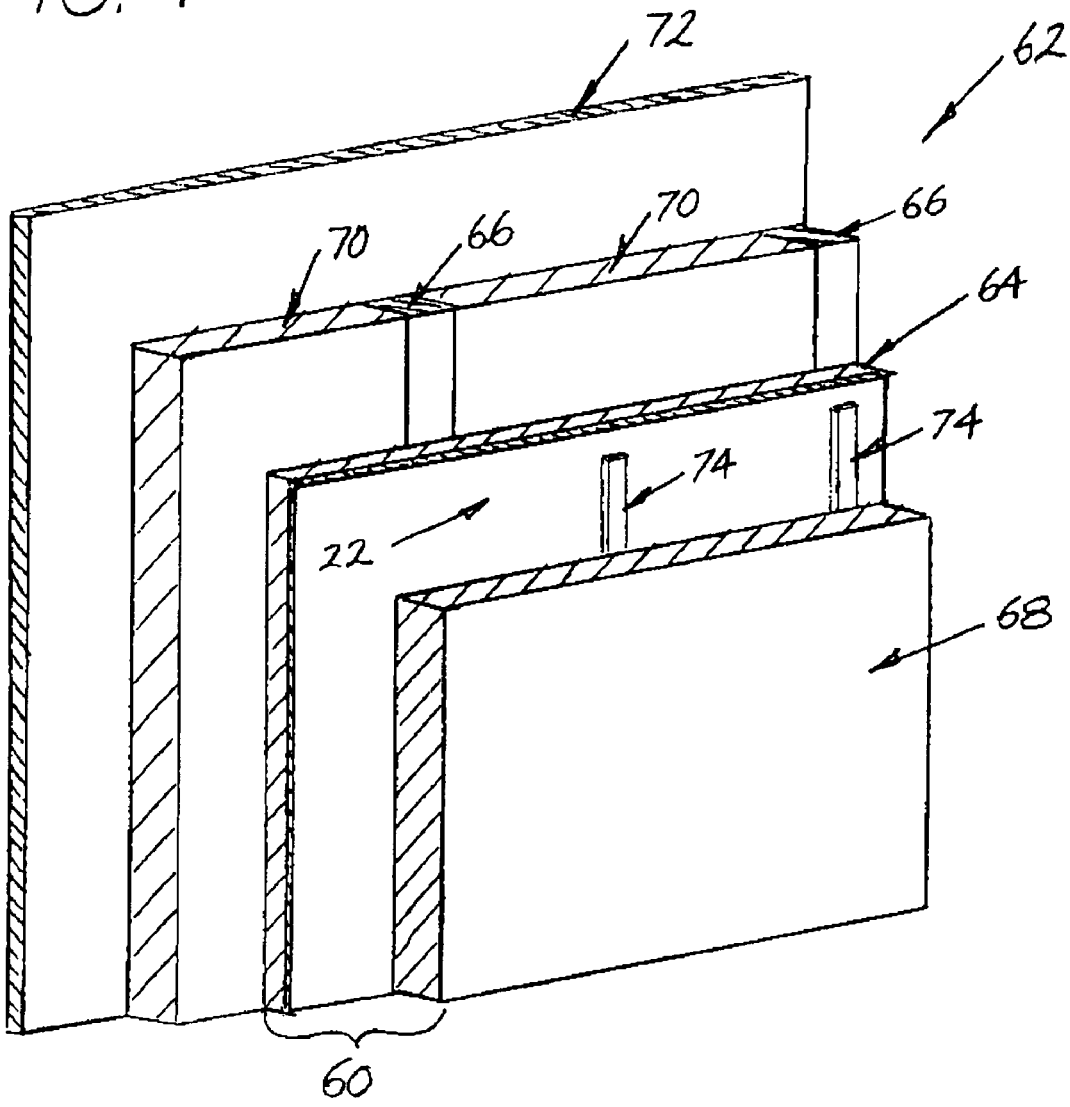
FIG. 4 is a schematic perspective view of an exterior wall embodying a building construction assembly of the subject invention with portions broken away to better illustrate the building construction assembly.

Another example 60 of a typical building construction assembly of the subject invention, forming part of an exterior building wall 62, includes: an exterior wall sheathing layer 64 overlying and secured to the exterior facing surfaces of load-bearing, wall framing members 66 of the exterior building wall; the building wrap coating layer 22 spray applied to, overlying, adhered to, and coextensive with or substantially coextensive with the exterior facing surface of the sheathing layer 64; and an exterior wall cladding layer 68 overlying the exterior facing surface of the building wrap coating layer 22. As shown in FIG. 4, the exterior building wall 62 also normally includes insulation, such as but not limited to blankets of fiberglass building insulation 70, in the wall cavities formed between the framing members 66 and an interior sheathing layer 72 formed of interior sheathing materials (such as but not limited to plasterboard, gypsum board, and other conventional interior sheathing materials) and secured to the interior facing surfaces of the framing members 66. Examples of exterior wall sheathing materials for forming the sheathing layer 64 are plywood, OSB, wooden boards, non-woven glass mat faced gypsum sheathing board, foam insulation sheathing, and other exterior wall sheathing materials commonly used in the construction industry. Examples of exterior wall cladding materials for forming the exterior wall cladding layer 68 are brick, concrete blocks, reinforced concrete, stone, synthetic stone, vinyl siding, fiber cement board, clapboard, or other conventional exterior siding materials commonly used in the construction industry. In the building construction assembly 60, generally vertically extending, spaced apart battens 74 are used to form the passages between the exterior facing surface of the building wrap coating layer 22 and an interior facing surface of the exterior building material cladding layer 68 for draining water from between and permitting air flow between the exterior facing surface of the building wrap coating layer 22 and the interior facing surface of the exterior building material cladding layer 68. While battens 74 [e.g. battens about 0.12 inches (about 3 mm) to about 0.24 inches (about 6 mm) in thickness] are preferred, other spacing members, which are not an integral part of the building wrap coating layer 22, may be employed to create the required spacing between the exterior facing surface of the building wrap coating layer and the interior facing surface of the exterior building material cladding layer 68 for water drainage and air flow. While shown in an exterior building wall, the building construction assembly 60 can also be employed in a sloped roofing system.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A spray applied building construction coating material for forming a waterproofing, water vapor permeable, air barrier, building-wrap layer between an exterior facing surface of exterior wall sheathing and an interior facing surface of an exterior wall cladding layer and/or an exterior facing surface of roof deck sheathing and an interior facing surface of an exterior roofing cladding layer, comprising:

a liquid, spray-applied, oil-based elastomeric emulsion coating material means for forming a waterproofing, water vapor permeable, air barrier coating layer, which, after being spray applied to sheathing, solidifies to form a waterproofing, water vapor permeable, air barrier coating layer having an exterior portion that forms an exterior facing surface of the coating layer, an inner portion that is in contact with and adhered to the sheathing, and an intermediate portion between the exterior portion and the inner portion of the coating layer wherein the oil-based elastomeric emulsion coating material means contains tung oil for causing the exterior portion of the coating material means solidifies at a different rate than rates at which the intermediate portion and the inner portion of the coating material means solidify to form wrinkles in the exterior facing surface of the exterior portion of the coating material means and to form an exterior facing, textured surface on the coating layer for providing passages between the exterior facing surface of the coating layer and an interior facing surface of an exterior cladding layer for draining water from between and permitting air flow between the exterior facing surface of the coating layer and the interior facing surface of the exterior cladding layer.

2. The spray applied building construction coating material for forming a waterproofing, water vapor permeable, air barrier layer according to claim 1, wherein:

the coating layer formed by the coating material means has an air permeability of 0.004 cfm/ft$^2$ [0.02 l/(s·m$^2$)] @ 75 Pa or less when the coating material means is spray applied to the exterior facing surface of the sheathing at a dry thickness of 0.12 inches and has a water vapor permeability greater than 1 perm when the coating material means is spray applied to the exterior facing surface of the sheathing at a dry thickness of up to 0.003 inches.

3. The spray applied building construction coating material for forming a waterproofing, water vapor permeable, air barrier layer according to claim 1, wherein:

the coating layer formed by the coating material means has an air permeability of 0.004 cfm/ft$^2$ [0.02 l/(s·m$^2$)] @ 75 Pa or less when the coating material means is spray applied onto the exterior facing surface of the sheathing at a dry thickness of 0.12 inches and has a water vapor permeability of 5 perms or greater when the coating material means is spray applied onto the exterior facing surface of the sheathing at an average dry thickness of up to 0.003 inches.

4. The spray applied building construction coating material for forming a waterproofing, water vapor permeable, air barrier layer according to claim 1, wherein:

the coating layer formed by the coating material means has a low emissivity of 0.30 or less to minimize solar heat absorption by the coating layer.

5. The spray applied building construction coating material for forming a waterproofing, water vapor permeable, sir barrier layer according to claim 1, wherein:

the coating material means contains a termiticide.

6. The spray applied building construction coating material for fanning a waterproofing, water vapor permeable, air barrier layer according to claim 1, wherein:

the coating material means contains a fungus growth-inhibiting agent.

7. The spray applied building construction coating material for forming a waterproofing, water vapor permeable, air barrier layer according to claim 1, wherein:

the coating material means contains a phase change material that absorbs and releases heat within a selected temperature range.

* * * * *